US008813848B2

(12) United States Patent
Frazier

(10) Patent No.: US 8,813,848 B2
(45) Date of Patent: Aug. 26, 2014

(54) ISOLATION TOOL ACTUATED BY GAS GENERATION

(76) Inventor: W. Lynn Frazier, Corpus Christi, TX (US)

( * ) Notice: Subject to any disclaimer, the term of this patent is extended or adjusted under 35 U.S.C. 154(b) by 467 days.

(21) Appl. No.: 13/134,102

(22) Filed: May 27, 2011

(65) Prior Publication Data

US 2011/0284243 A1 Nov. 24, 2011

Related U.S. Application Data

(63) Continuation-in-part of application No. 12/800,622, filed on May 19, 2010, now abandoned.

(51) Int. Cl.
*E21B 29/00* (2006.01)
*E21B 34/06* (2006.01)

(52) U.S. Cl.
CPC ..... *E21B 34/063* (2013.01)
USPC ..... 166/317; 166/376; 166/377

(58) Field of Classification Search
USPC ..... 166/376, 317, 377
See application file for complete search history.

(56) References Cited

U.S. PATENT DOCUMENTS 4,683,943 A * 8/1987 Hill et al. ..... 166/63
4,901,802 A * 2/1990 George et al. ..... 175/4.52
5,924,696 A 7/1999 Frazier
6,397,950 B1 * 6/2002 Streich et al. ..... 166/376
7,044,230 B2 5/2006 Starr
7,210,533 B2 5/2007 Starr
7,287,596 B2 10/2007 Frazier
7,350,582 B2 4/2008 McKeachnie et al.
7,455,116 B2 11/2008 Lembcke et al.
7,513,311 B2 * 4/2009 Gramstad et al. ..... 166/376
2007/0074873 A1 4/2007 McKeachnie
2007/0284119 A1 12/2007 Jackson
2008/0271898 A1 11/2008 Turley
2009/0056955 A1 3/2009 Slack

* cited by examiner

*Primary Examiner* — Cathleen Hutchins
*Assistant Examiner* — Taras P Bemko
(74) *Attorney, Agent, or Firm* — G. Turner Moller

(57) ABSTRACT

A down hole pressure isolation tool is placed in a pipe string and includes a pair of pressure discs having one side that is highly resistant to applied pressure and one side that ruptures when much lower pressures are applied to it. The weak sides of the pressure discs face each other. Rather than rupturing the discs by dropping a go-devil into the well, in some embodiments, a first of the discs is ruptured or broken by the application of fluid pressure from the well head or surface. Formation pressure is then used, in different ways according to the different embodiments, to rupture the remaining disc. In another embodiment, a gas generating assembly located between the discs is actuated to produce enough pressure to rupture the discs.

17 Claims, 8 Drawing Sheets

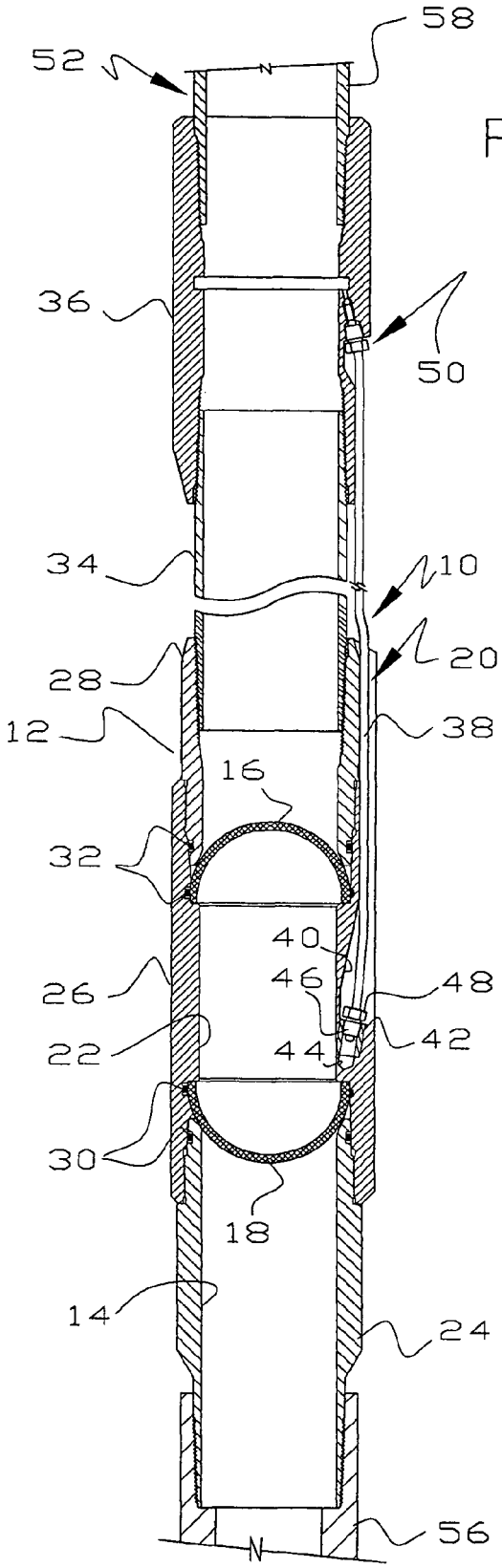
Fig.1
Fig.2
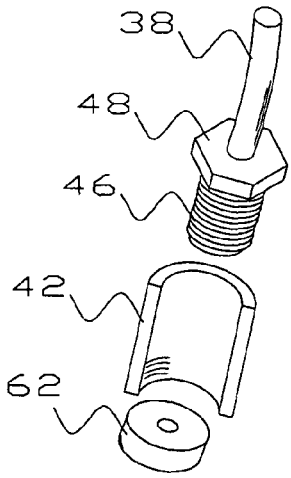

ISOLATION TOOL ACTUATED BY GAS GENERATION

This application is a continuation-in-part of application Ser. No. 12/800,622, filed May 19, 2010 now abandoned.

This invention relates to a tool used in wells extending into the earth and, more particularly, to a tool for isolating one section of a pipe string from another section.

BACKGROUND OF THE INVENTION

There are a number of situations, in the completion of oil and gas wells, where it is desirable to isolate one section of a subterranean well from another. For example, in U.S. Pat. No. 5,924,696, there is disclosed an isolation tool used alone or in combination with a packer to isolate a lower section of a production string from an upper section. This tool incorporates a pair of oppositely facing frangible or rupturable discs or half domes which isolate the well below the discs from pressure operations above the discs and which isolate the tubing string from well bore pressure. When it is desired to provide communication across the tool, the upper disc is ruptured by dropping a go-devil into the well from the surface or well head which falls into the well and, upon impact, fractures the upwardly convex ceramic disc. The momentum of the go-devil normally also ruptures the lower disc but the lower disc may be broken by application of pressure from above, after the upper disc is broken, because the lower disc is concave upwardly and thereby relatively weak against applied pressure from above.

An important development in natural gas production in recent decades has been the drilling of horizontal sections through zones that have previously been considered uneconomically tight or which are shales. By fracing the horizontal sections of the well, considerable production is obtained from zones which were previously uneconomical. For some years, the fastest growing segment of gas production in the United States has been from shales or very silty zones that previously have not been considered economic. The current areas of increasing activity include the Barnett Shale, the Haynesville Shale, the Fayetteville Shale, the Marcellus Shale, the Eagle Ford Shale in the United States, the Horn River Basin of Canada and other shaley formations in North America and Europe.

It is no exaggeration to say that the future of natural gas production in the continental United States is from these heretofore uneconomically tight gas bearing formations. In addition, there are many areas of the world where oil and gas is produced and costs are, from the perspective of a United States operator, exorbitantly high. These areas currently include offshore Africa, the Middle East, the North Sea and deep water parts of the Gulf of Mexico. Accordingly, a development that allows well completions at overall lower costs is important in many areas of the world and in many different situations.

Disclosures of interest relative to this invention are found in U.S. Pat. Nos. 7,044,230; 7,210,533 and 7,350,582 and U.S. Printed Patent Applications S.N. 20070074873; 20080271898 and 20090056955.

SUMMARY OF THE INVENTION

The device disclosed in U.S. Pat. No. 5,924,696 can be used in a horizontal section of a well to isolate the well below the tool from pressure operations above the tool. However, the upper disc has to be broken or weakened in a mechanical fashion requiring a bit trip, typically a coiled tubing trip in modern high tech wells or a bit trip with a workover rig in more traditional environments, to fracture the upper disc because a go-devil dropped through the vertical section of the well does not have sufficient momentum to reach and then fracture the upper disc. Theoretically, sufficient pressure could be applied from above to break the upper disc from the concave side but this pressure is commonly so high that it would damage or destroy other components of the production string. It has been realized that it would be desirable to provide an isolation tool which can be used in a horizontal section of a well without requiring a bit trip.

As disclosed herein, a pressure differential that is uniform across the pressure disc is created by manipulating pressure at the surface or through the well head to fracture a first of the discs. The other disc may be ruptured using pressure in the well. The exact sequence of breaking the discs may depend on the particular design employed and whether the isolation tool is located above or below a packer or other sealing element isolating the production string, typically from a surrounding pipe string.

Several embodiments of an isolation tool are disclosed that may be used in wells to temporarily isolate a section of the well below the tool from a section above the tool. These embodiments use a pressure differential to fracture a first of the discs. In one embodiment, a capillary tube is provided from above the upper disc to a location between the discs. In a second embodiment, a check valve admits pressurized well fluid between the discs so that one of the discs may be broken by reducing the pressure on one side of the isolation tool. In a third embodiment, an unvalved opening admits pressurized well fluid between the discs so that one of the discs may be broken by reducing the pressure on one side of the isolation tool. In a fourth embodiment, a movable member is displaced by pressure supplied from above to break a first of the discs. In a fifth embodiment, a gas generating assembly is disposed between a pair of pressure discs. When ignited, the gas generating assembly produces sufficient gas to provide a pressure which breaks both discs.

It is an object of this invention to provide an improved down hole well tool to isolate one section of a well from another.

A more specific object of this invention is to provide an improved isolation sub that can be manipulated by a pressure differential to place isolated sections of a well into communication.

Another object of this invention is to provide an improved isolation sub that can be manipulated by a gas generating assembly located between a pair of pressure discs.

These and other objects and advantages of this invention will become more apparent as this description proceeds, reference being made to the accompanying drawings and appended claims.

BRIEF DESCRIPTION OF THE DRAWINGS

FIG. 1 is a cross-sectional view of one embodiment of an isolation tool that incorporates a pair of oppositely facing pressure discs;

FIG. 2 is an exploded view of a component of the device of FIG. 1;

DETAILED DESCRIPTION OF THE INVENTION

Figure 6:
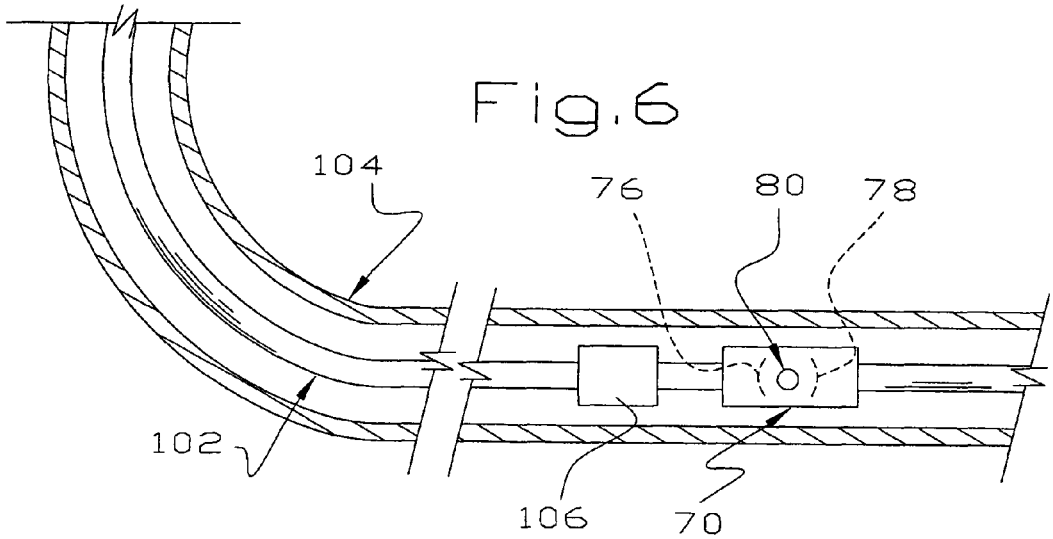
FIG. 6 is a view similar to FIG. 2, illustrating operation of the embodiment of FIGS. 4 and 5.

Referring to FIGS. 1-2, there is illustrated an isolation tool or sub 10 comprising a housing 12 having a passage 14 therethrough, upper and lower rupturable pressure discs 16, 18 and a capillary tube 20 opening into a chamber 22 between the discs 16, 18.

The housing 12 may comprise a lower end, pin body or pin 24, a central section 26, an upper end or box body 28 and suitable sealing elements or O-rings 30, 32 captivating the discs 16, 18 in a fluid tight manner. Except for the capillary tube 20, those skilled in the art will recognize the isolation sub 10, as heretofore described, as being typical of isolation subs sold by Magnum International, Inc. of Corpus Christi, Tex. and as also described in U.S. Pat. No. 5,924,696.

The capillary tube 20 may be external to the housing 12, or an internal passage may be provided, and may terminate in an extension of the central section 26 or in the upper section 28. One problem that is occasionally encountered is sufficient debris above the upper disc 16 which might seal off pressure from reaching the capillary tube 20. To overcome this problem, the capillary tube 20 may be of greater length as by providing one or more pipe sections 34 of any suitable length connected to a collar or other sub 36 thereby elongating the housing 12. This will accommodate debris, such as sand or the like, from bridging off access to the top of the capillary tube 20.

The discs 16, 18 may be of any suitable type having the capability of being stronger in one direction than in an opposite direction. Conveniently, the discs 16, 18 may be curved or generally hemispherical domes made of any suitable material, such as ceramic, porcelain, glass and the like. Suitable ceramic materials, such as alumina, zirconia and carbides are currently commercially available from Coors Tek of Golden, Colo. These materials are frangible and rupture in response to either a sharp blow or in response to a pressure differential where high pressure is applied to the concave side of the discs 16, 18. Because of their curved or hemispherical shape, half domes may be a preferred selection because of their considerable ability to resist pressure from the convex side, their much lower ability to resist pressure from the concave side, cost, reliability and frangibility. Ceramic discs of this type are available in a variety of strengths but a typical disc may have the capability of withstanding 25,000 psi applied on the convex side but only 1500 psi applied on the concave side. In a typical situation, the discs 16, 18 may be 10-20 times stronger against pressure applied to the convex side than to the concave side. Any pressure disc which has greater strength in one direction than in the opposite may be used, another example of which are metal Scored Rupture Disc Assemblies available from Fike Corporation of Blue Springs, Mo. or BS&B of Tulsa, Okla. The Fike discs that are stronger in one direction than the other are also concave on the weak side and convex on the other which is a convenient technique for making the discs stronger in one direction than in an opposite direction and thus responsive to different sized pressure differentials.

The capillary tube 20 includes a tube 38 of any suitable outside and inside diameter so long as it transmits pressure, either higher or lower than hydrostatic pressure in the well applied from above the tool 10. The tube 20 may be connected to the central section 26 in a recess 40 by a nipple 42 threaded, pressed or otherwise connected to the central section 26. The nipple 42 communicates with a passage 44 opening into the chamber 22 so any pressure, higher or lower than hydrostatic pressure, applied above the tool 10 is delivered between the discs 16, 18. A connector 46 may be threaded into the nipple 42 as driven by a wrench (not shown) acting on a polygonal nut 48. A similar or dissimilar fitting 50 may connect an upper end of the tube 38 to the collar 36.

Figure 3:
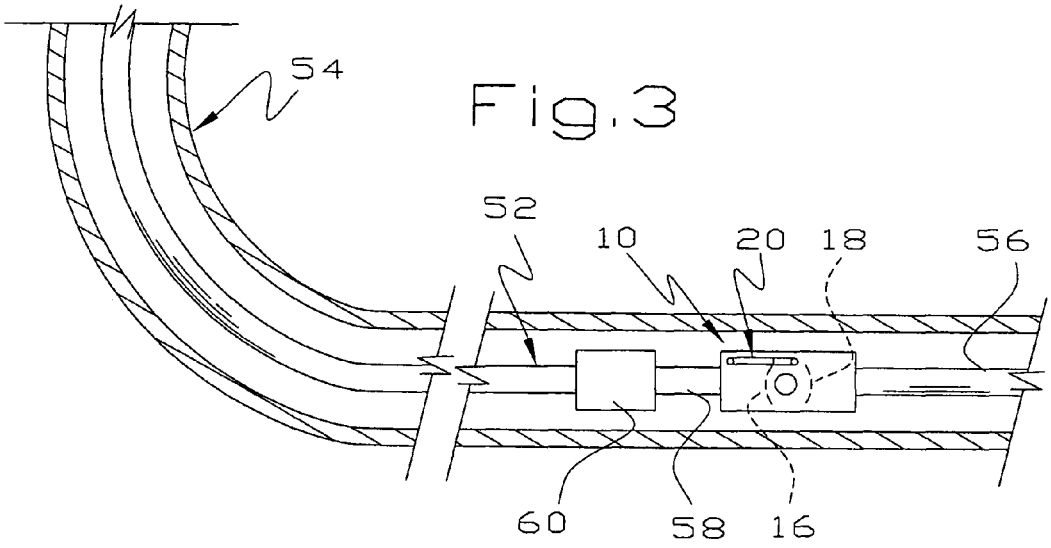
FIG. 3 is a schematic view of a well in which the isolation tool of FIG. 1 is employed.

Referring to FIG. 3, a typical example of using the isolation tool 10 is illustrated. The isolation tool 10 may comprise part of a horizontal or inclined section of a production string 52 inside a casing string 54 which intersects a productive zone where one or more pipe joints 56 may be disposed below the tool 10 and a series of pipe joints 58 may be disposed above the tool 10 leading to the surface or well head so formation fluids may be produced. A typical use of the isolation tool 10 is to isolate the productive zone below a packer 60 from pressure operations above the tool 10 which operations typically set the packer 60. Another typical use of the isolation tool 10 is in setting a liner during drilling of a deep well.

At the outset and throughout the packer setting operation, there is hydrostatic pressure inside the production string 52 and in the annulus between the production string 52 and the casing string 54, meaning there is hydrostatic pressure above the upper disc 16, in the chamber 22 and below the lower disc 18, so there is no pressure differential operating on the discs 16, 18 which would tend to break them. The packer 60 is set by applying pressure downwardly through the production string 52. Any pressure applied from above acts on both sides of the upper disc 16 so the upper disc 16 sees no pressure differential and there is no tendency of the upper disc 16 to fail. So long as the packer 60 is set by a pressure that is less than the sum of hydrostatic pressure at the tool 10 and the strength of the disc 18 against pressure applied on the concave side, the packer 60 may be manipulated without fracturing the lower disc 18.

After the packer 60 is set, pressure is applied from above and transmitted through the capillary tube 20 to a location between the discs 16, 18. This applied pressure is greater than the hydrostatic pressure in the well and creates a pressure differential which is uniform over the area of the disc 18 and which exceeds the ability of the concave side of the lower disc 18 to withstand it. The lower disc 18 then shatters or ruptures allowing well pressure to enter the chamber 22. When pressure in the production string 52 above the tool 10 is lowered, as by stopping the pumps which have created the pressure to set the packer 60, by swabbing the production string 52, gas lifting the production string 52 or simply opening the production string 52 to the atmosphere at the surface or well head, well pressure acting on the concave side of the upper disc 16 exceeds its ability to withstand pressure in this direction whereupon the upper disc 16 fails thereby placing the production string 52, above and below the tool 10, in communication and allowing the well to produce. Thus, the tool 10 allows breaking of the discs 16, 18 to place the heretofore isolated parts of the well in communication by the application of pressure from above. In this situation, the pressure that breaks the lower disc 18 is applied from above and produces a pressure at the tool 10 that is greater than hydrostatic pressure but far less than what would rupture the disc 16 if applied from above.

Many, if not most, hydraulically set packers require more pressure above hydrostatic than the concave side of the lower disc 18 can withstand. To overcome this problem, an inline pressure disc 62 may be provided in the capillary tube 20 as shown best in FIG. 3. In some embodiments, the pressure disc 62 may be located between the nipple 42 and the passage 44, may be located inside the nipple 42, inside the fitting 50 or any other suitable location. The pressure disc 62 may be of any suitable type to provide a sufficient resistance to allow the packer 60 to be hydraulically set without rupturing the lower disc 18. In some embodiments, the pressure disc 62 is commercially available from Fike Corporation of Blue Springs, Mo. and known as Scored FSR Rupture Disc Assembly. In a typical situation, the packer 60 may require an applied pressure of 3500 psi above hydrostatic to set. In such situations, the pressure disc 62 may be selected to rupture at a substantially greater pressure, e.g. 4500 psi. Thus, the packer 60 would be set and then additional pressure would be applied to rupture the disc 62 which would place sufficient pressure in the chamber 22 to fracture the lower disc 18. The upper disc 16 would not rupture immediately because there is initially no pressure differential across the upper disc 16 because the pressure applied from the surface is on both sides of the upper disc 16. After the lower disc 18 fails, pump pressure applied from the surface is reduced whereupon formation pressure applied from below produces a pressure differential sufficient to rupture the upper disc 16.

In some embodiments, a check valve (not shown) may be provided in the fitting 50 to allow flow inside the tubing string 58 to enter the chamber 22 but prevent flow out of the chamber 22.

It will be seen that the tool 10 is designed to cause one of the pressure discs 16, 18 to fail by creation of a pressure differential that is substantially below the differential pressure which would cause failure if applied to the strong or convex side of the pressure discs 16, 18.

Figure 4:
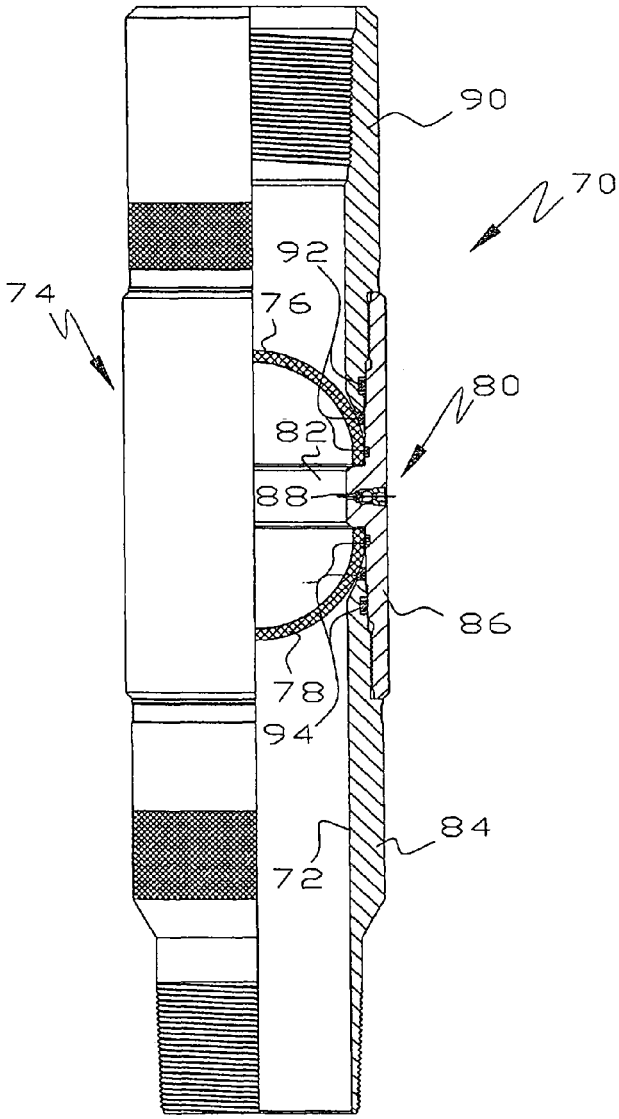
FIG. 4 is a cross-sectional view of another embodiment of an isolation tool that incorporates a pair of oppositely facing pressure discs.

Referring to FIG. 4, there is illustrated another isolation tool 70 providing a passage 72 therethrough and comprising, as major components, a housing 74, first and second pressure discs 76, and a valve assembly 80 allowing hydrostatic pressure from outside the tool 70 to enter a chamber 82 between the pressure discs 76, 78.

The housing 74 may comprise a lower end or pin body 84, a central section or collar 86 providing a passage 88 into the chamber 82, an upper end or box body 90 and suitable sealing elements or O-rings 92, 94 captivating the discs 76, 78 in a fluid tight manner. The pressure discs 76, 78 may be of the same type and style as the pressure discs 16, 18 and are capable of resisting a greater pressure from one direction than the other. Except for the valve assembly 80, those skilled in the art will recognize the isolation sub 70, as heretofore described, as being typical of isolation subs sold by Magnum International, Inc. of Corpus Christi, Tex. and as also being described in U.S. Pat. No. 5,924,696.

The valve assembly 80 comprises a check valve which allows flow into the chamber 82 so hydrostatic pressure is delivered between the discs 76, 78 during normal operations, such as when the tool 70 is being run into a well. The valve assembly 80 may comprise a spring 96 biasing a ball check 98 against a valve seat 100. It will be seen that the check valve 80 allows the maximum hydrostatic pressure to which the tool 70 is subjected to appear in the chamber 82. Under normal conditions, there is no tendency for the pressure in the chamber 82 to rupture the discs 76, 78 because the same pressure exists on the inside and outside of the tool 70.

Referring to FIG. 6, the isolation tool 70 is illustrated in a production string 102 inside a casing string 104. A pressure actuated packer 106 may be above the isolation tool 70. The production string 102 may extend past the tool 70 toward a hydrocarbon formation. Initially, the isolation tool 70 pressure separates the production string 102 into two segments. Because of the inherent strength of the convex side of the illustrated disc 76, the applied pressure may be sufficiently high to conduct any desired pressure operation. After the packer 102 is set or when it is desired to place the well below the tool 70 in communication with the production string 102 above the tool 70, steps are conducted to reduce pressure above the upper disc 76. This may be done in any suitable manner, as by opening the production string 102 at the surface or through the well head, swabbing the production string 102, gas lifting the production string 102 or the like. When the pressure above the upper disc 76 declines sufficiently, a pressure differential is created across the upper disc 76 which is sufficient to rupture the upper disc 76. This pressure differential is much smaller than a pressure differential caused by the application of positive pressure to the convex side of the upper disc 76 that is sufficient to rupture it. For example, the convex side of the disc 76 may be rated to withstand a pressure differential of 25,000 psi but the embodiment of FIG. 4 acts to rupture the upper disc 76 upon creating a much smaller pressure differential applied to the concave side of the disc 76.

After the upper disc 76 ruptures, pressure may be applied at the surface through the production string 102 by a suitable pump (not shown) to create a pressure differential across the lower disc sufficient to rupture it. In this manner, the heretofore pressure separated sections of the well are now in communication.

Figure 5:
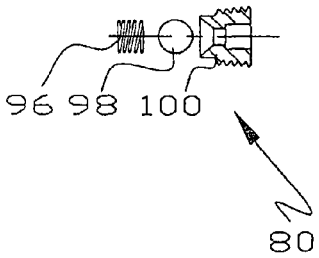
FIG. 5 is an enlarged view of a valve assembly used in the embodiment of FIG. 4.
Figure 7:
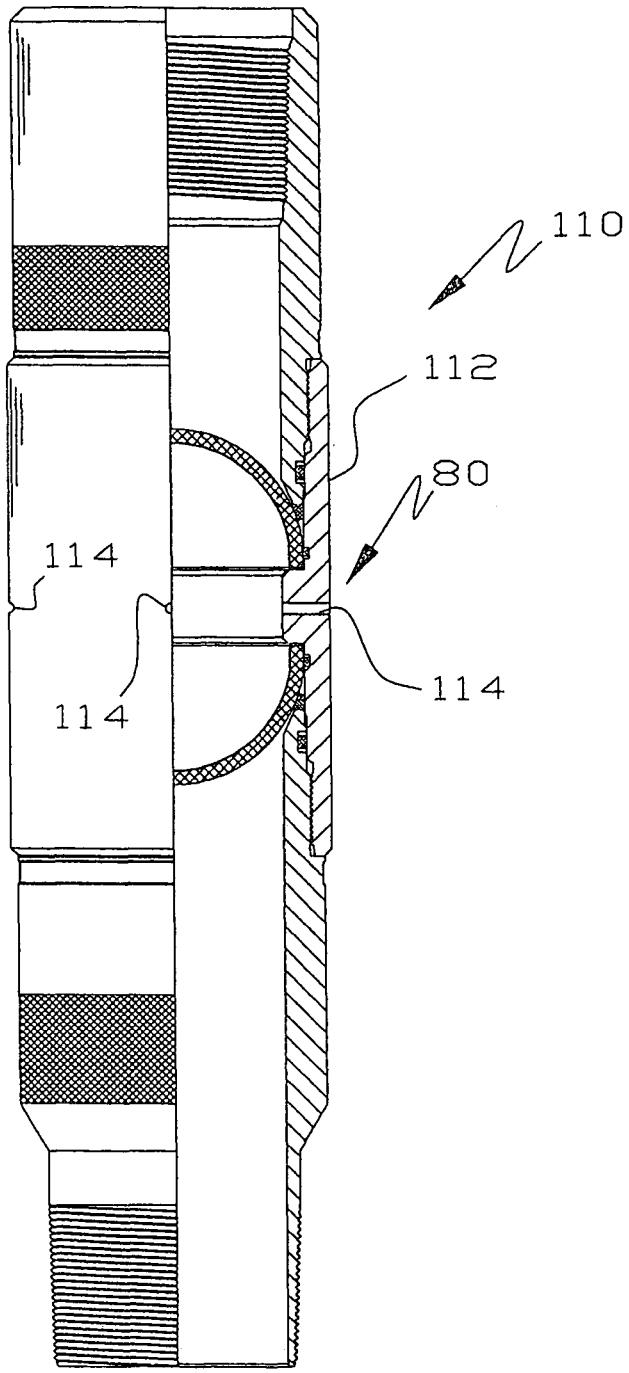
FIG. 7 is a partial view of another embodiment of this invention, based on the embodiment of FIG. 4.

Referring to FIG. 7, there is illustrated another isolation tool 110 which may be identical to the tool 70 except that the check valve assembly 80 has been eliminated. Thus, the tool 110 may include a collar 112 having one or more continuously open or unvalved passages 114 therein communicating between the pressure discs. By continuously open, it is meant that the passage 114 is open when the tool 110 is in the well. Surprisingly, the tool 110 works in the same manner as the tool 70 because the passage 114 allows hydrostatic pressure to build up between the discs. When liquids above the upper disc are removed, a pressure differential is created across the upper disc in its weak direction thereby rupturing the upper disc. The lower disc is broken in the same manner as the lower disc 78 which may be by pumping into the tool 110. Besides the advantage of simplicity, the tool 110 also has an advantage when it becomes necessary or desirable to remove the production string and packer from the well without setting the packer. In the embodiment of FIGS. 4-5, pulling the tool 70 from the well will reduce pressure above the upper disc 76 and below the lower disc 78 so the trapped pressure in the chamber 82 will likely cause one of the discs 76, 78 to fail. By removing the check valve assembly 80, the isolation tool 110 may be pulled from the well without rupturing either of the pressure discs because hydrostatic pressure will bleed off from between the discs at the same rate as it falls above the upper disc and below the lower disc. By eliminating the check valve assembly 80, there is created an isolation tool which will not rupture when the tool is pulled from the well.

Figure 8:
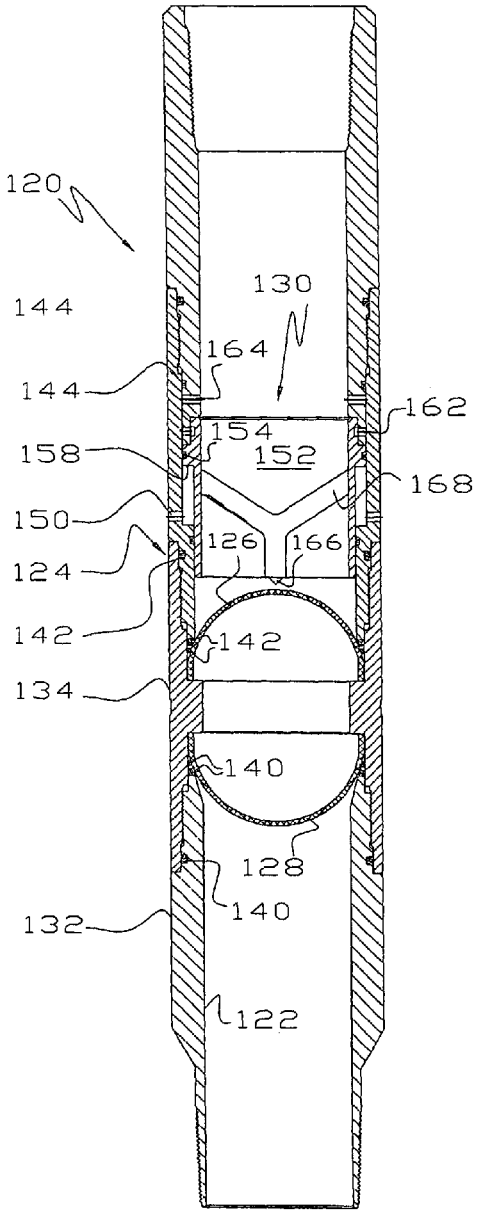
FIG. 8 is a cross-sectional view of another embodiment of an isolation tool that incorporates a pair of oppositely facing pressure discs, illustrating the tool in a position where upper and lower sections of the well are isolated.
Figure 9:
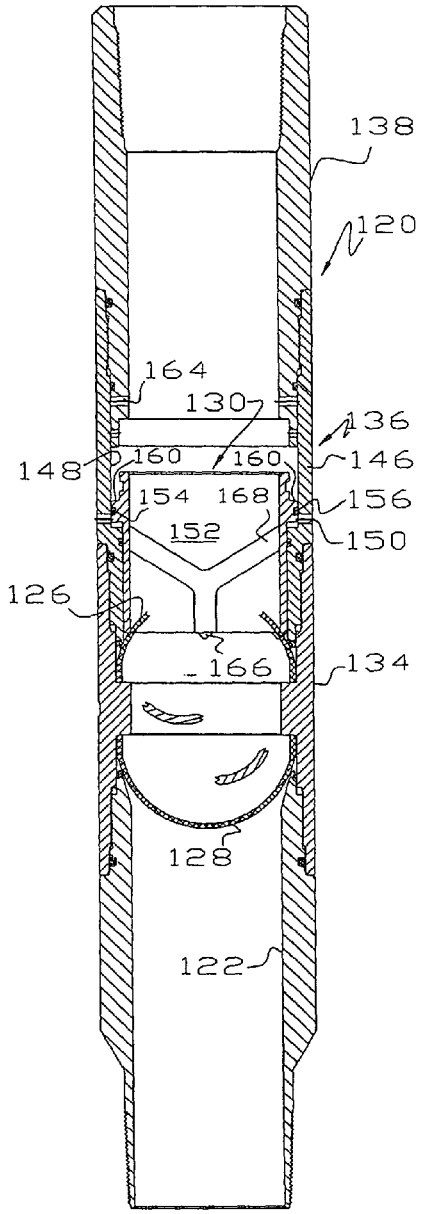
FIG. 9 is a cross-sectional view of the embodiment of FIG. 5 illustrating the tool in the process of breaking one of the pressure discs.

Referring to FIGS. 8-9, there is illustrated another isolation tool 120 providing a passage 122 therethrough and comprising, as major components, a housing 124, first and second frangible pressure discs 126, 128 and an assembly 130 responsive to pressure inside the tool 120 to rupture the discs 126, 128.

The housing 124 may comprise a lower end or pin body 132, a central section or collar 134, a section 136 that cooperates with the assembly 130, an upper end or box body 138, and suitable sealing elements or O-rings 140, 142 captivating the discs 126, 128 in a fluid tight manner. Another set of seals or O-rings 144 seal between the section 136 and the box body 138.

The section 136 includes a wall 146 of reduced thickness providing a recess 148 open to the exterior of the tool 120 through one or more passages 150. The assembly 130 may include a sleeve 152 having an annular rim 154 comprising a pressure reaction surface. An O-ring or other seal 156 may seal between the rim 154 and the inside of the wall 146 to provide a piston operable by a pressure differential between hydrostatic pressure in the well acting through the passage 150 against the underside 158 of the rim 154 and pressure applied from above acting on the top 160 of the rim 154. The sleeve 152 may normally be kept in place by a shear pin 162 or other similar device.

It will be seen that a pressure applied from above through the inside of the tool 120 passes through an opening 164 in the box body 138 and acts on the top 160 of the rim 154. When the downward force applied in this manner sufficiently exceeds the upward force on the rim 134 by hydrostatic pressure outside the tool 120, the shear pin 162 fails and the sleeve 152 moves from an upper position shown in FIG. 8 to a lower position shown in FIG. 9.

The bottom of the sleeve 152 may be equipped with a suitable aid to fracture the upper disc 126. This may be a pointed element 166 attached to the inside of the sleeve 152 in any suitable manner, as by a lattice work frame 168.

As in the previously described embodiments, the isolation tool 120 may be used in any situation where it is desired to pressure separate one section of a hydrocarbon well from another. Assuming the tool 120 is run in a production string analogous to those shown in FIGS. 2 and 6, pressure applied from above is sufficient to hydraulically set a packer (not shown) but is not sufficient to shear the pin 162. After the packer (not shown) is set, additional pressure is applied from above which is sufficient to shear the pin 162 but is not sufficient to fracture the convex side of the disc 126. When the pin 162 shears, the sleeve 152 moves downwardly with sufficient force that the point 166 impacts the frangible disc 126 thereby rupturing it. Pressure inside the tool 120 is sufficient to rupture the much weaker lower disc 128 because the pressure differential is applied to the concave side of the disc 128.

Thus, in common with the tools 10, 70, the isolation tool 120 opens communication between the previously isolated parts of a well upon the application of pressure from above that is less than the rated capacity of the convex side of the upper disc 126.

Figure 11:
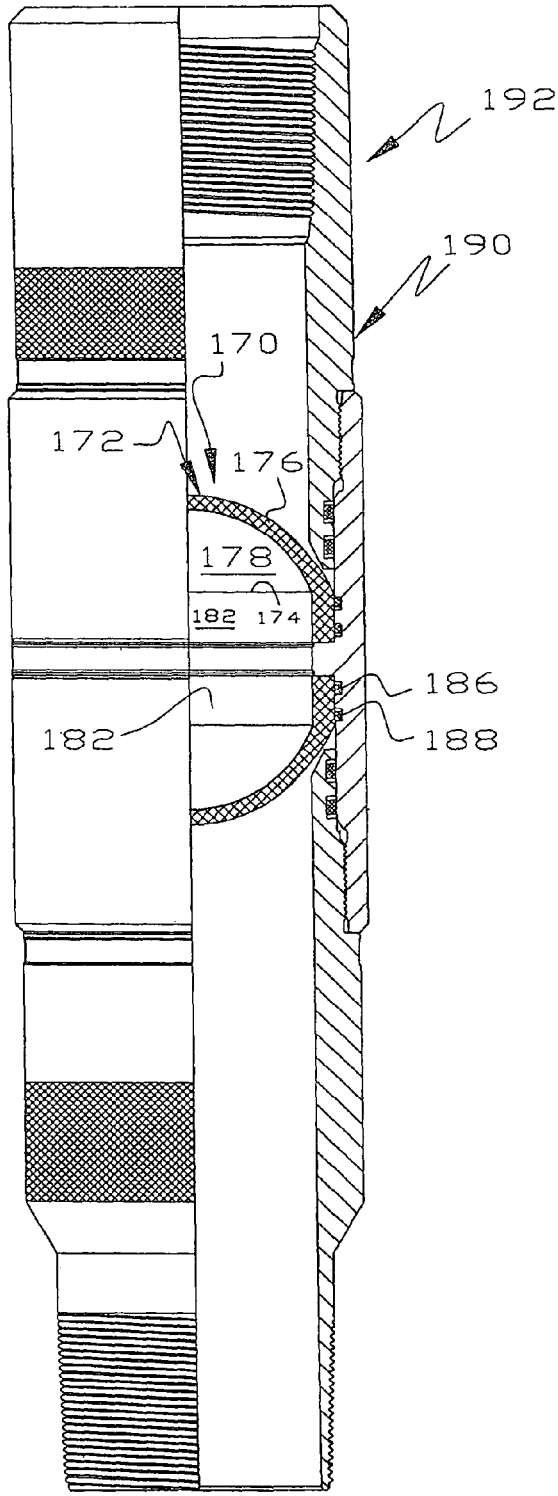
FIG. 11 is a view of the pressure dome of FIG. 10 in an isolation tool.
Figure 10:
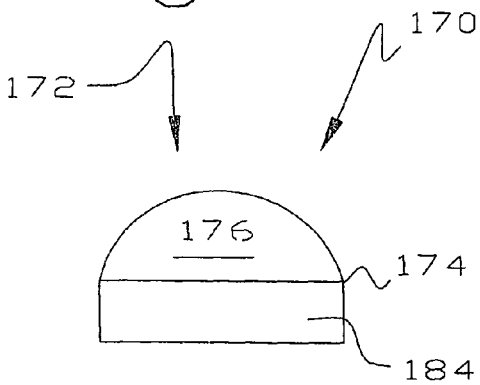
FIG. 10 is an isometric view of a modified pressure dome.

Referring to FIGS. 10-11, an improved pressure disk 170 is illustrated having a generally hemispherical central section 172 providing a circular edge 174, a convex outer surface 176, a concave inner surface 178 and a cylindrical skirt 180 extending substantially from the circular edge 174 below the curved portion of the disk 170. The cylindrical skirt 180 includes an inner cylindrical wall 182 and an outer cylindrical wall 184 providing an extended sealing area as shown in FIG. 11 where multiple sealing elements or O-rings 186, 188 seal between the disk 170 and a housing 190 which may be part of an isolation tool 192 or other tool where a frangible pressure disk is necessary or desirable.

The advantage of the elongate cylindrical skirt 180 is it provides sufficient area for multiple sealing elements, such as a pair of O-rings or other seals or one or more seals with a backup seal or device. It is much simpler to seal against the outer cylindrical wall 184 than against a curved portion of the hemispherical central section 172. In fact, seals heretofore used with hemispherical pressure disks of the type disclosed herein were crushed to accommodate and seal against the arcuate side of the pressure disk. Sealing against the cylindrical surface 182 is much simpler, more reliable, more reproducible and more efficient. Thus, the skirt 180 may be of any suitable length sufficient to provide a cylindrical surface of sufficient length to receive at least one seal member on the O.D. and, preferably, two seal members. Thus, in a typical situation in disks 170 of 2" diameter and greater the skirt 180 may be at least 1" long.

The disk 170 may be made of any frangible material, such as ceramic, porcelain or glass, i.e. from the same materials as the pressure disks previously described.

It will be apparent that the outer cylindrical wall 184 may be manufactured in a variety of techniques. One simple technique is to grind the outer diameter of a hemispherical disk to provide the cylindrical wall 184. A preferred technique may be to manufacture the disk 170 with an elongate cylindrical skirt 180 as illustrated in FIGS. 10-11 and then grind the outer diameter to a smoothness compatible with O-ring type seals. This smoothness, known to machinists as a seal finish or O-ring seal finish is known more technically as 63-32 on a scale known as RMS or Root Mean Square. In this system, and simplified for purposes of illustration, the number is a measure, in microns, of the difference between the heights of small protrusions and the depths of small depressions in the surface. The smaller the number, the smoother the surface.

Figure 12:
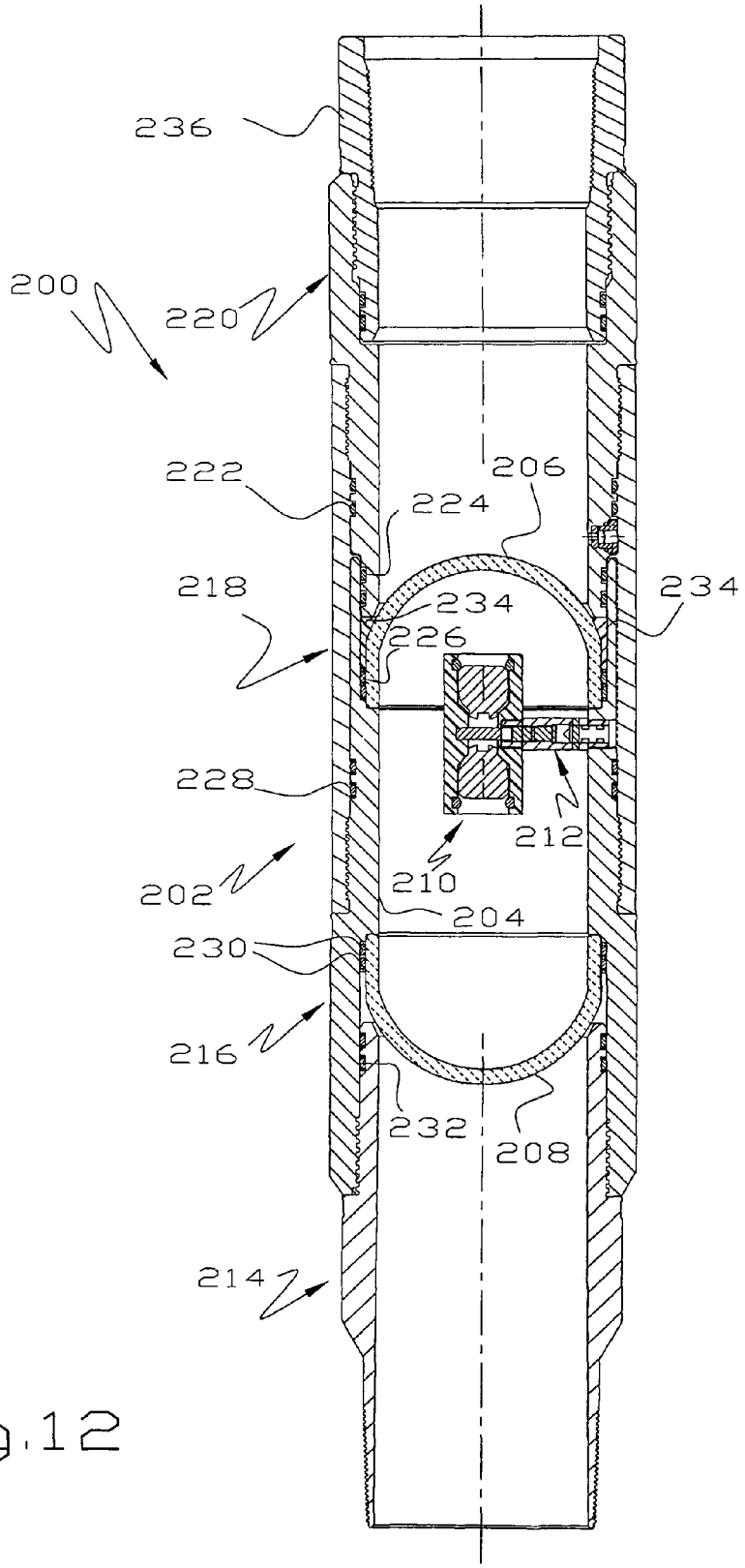
FIG. 12 is a cross-sectional view of another embodiment of an isolation tool.
Figure 13:
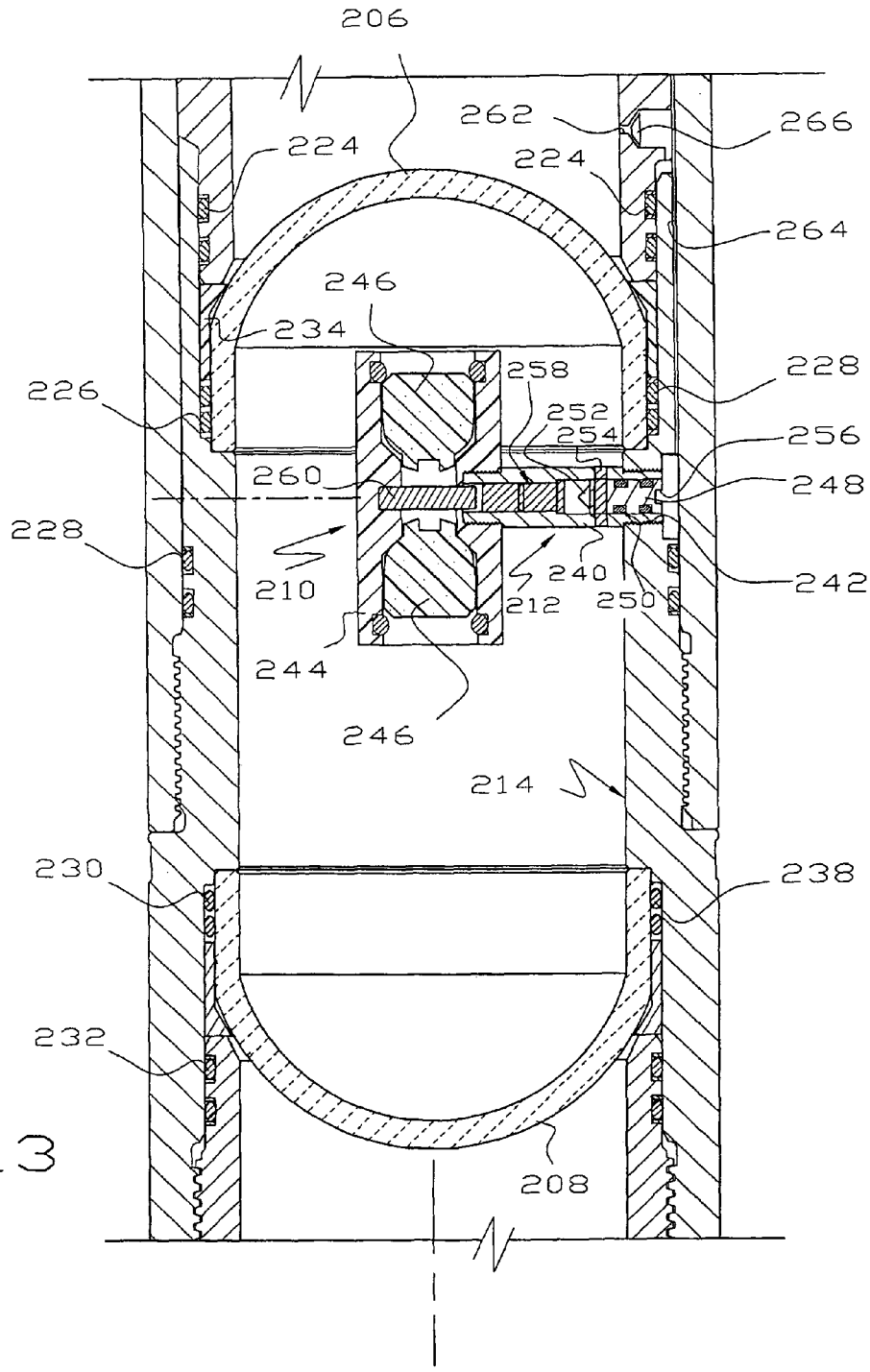
FIG. 13 is an enlarged view of the central part of the embodiment of FIG. 12.

Referring to FIGS. 12-13, there is illustrated another embodiment of an isolation tool or sub 200 comprising a housing 202 having a passage 204 therethrough, upper and lower rupturable pressure discs 206, 208 and a gas generating assembly 210 including an ignition train 212. The housing 202 may comprise a lower end, pin body or pin 214, a central section 216, a sleeve 218, an upper end or box body 220 and suitable O-rings 222, 224, 226, 228, 230, 232 and a cartridge seal or spacer 234 captivating the discs 206, 208 in a fluid tight manner. A protective cap (not shown) may be provided for each end of the sub 200 during transit to prevent shrapnel from the discs 206, 208 from exiting the housing 202 in the event of an inadvertent firing of the gas generating assembly 210. Thus, the isolation tool 200 may be more-or-less similar to the tools 10, 70, 110, 120, although the discs 206, 208 may be spaced somewhat further apart to accommodate the gas generating assembly 210. An adapter 234 may be provided to thread into the box 218 and provide desired threads for the pipe string in which the tool 200 is placed. The protective caps are removed before the tool 200 is run into a well.

The gas generating assembly 210 produces sufficient gas to provide a pressure between the discs 206, 208 sufficient to rupture at least one of them and may preferably be sufficient to rupture both simultaneously. This may be advantageous when it becomes difficult to provide sufficient pressure between the discs 206, 208 to overcome the hydrostatic pressure to which one or the other of the discs may be exposed. As shown best in FIG. 13, the gas generating assembly 210 may include a support 240 such as a brass nipple threaded into a through opening 242 in the central section 216. The assembly 210 may also include a housing 244 in which are located one or more gas generating charges 246.

The gas generating charges 246 may be shaped charges of the type used in perforating guns, may be quantities of rocket propellant or may be other sources of gas in sufficient quantity to create a pressure between the discs 206, 208 that is sufficient to rupture one or both of the discs 206, 208. In the case of shaped charges and rocket propellant, the buildup of pressure between the discs 206, 208 is almost instantaneous and the amount of pressure generated is sufficient to rupture both discs 206, 208 simultaneously. The mechanism by which the discs 206, 208 rupture may vary considerably depending on which type of gas generating charge 246 is used. If shaped charges are used, the jet emanating from the shaped charge is extremely hot so the discs 206, 208 may rupture or be breached from a combination of heat, shock wave and/or pressure. If rocket propellant is used, gas emanating therefrom is hot but not nearly so hot as the jet from shaped charges. Thus, the rupture may be due more to pressure than to heat or shock wave. If a lower temperature source is used, such as a very slow burning propellant, rupture may be due wholly from pressure effects with no substantial temperature or shock wave effect.

The ignition train 212 may be of any suitable type and its operative components may reside inside the support 232. To this end, the ignition train 212 may include a pressure operated firing pin or piston assembly 248 mounted for movement inside the support 240. One or more O-rings 250 may seal between the assembly 240 and the inside of the support 232. A firing pin 252 on the end of the assembly 240 may be provided to start the ignition train 212. A shear pin 254 may hold the assembly 248 against movement until the application of sufficient pressure to the assembly 248. The pin assembly 248 can have a screwdriver slot 256 in one end so the assembly 248 can be easily rotated to align the shear pin passages. The ignition train 212 may include a percussion detonator 258 of a conventional type to start ignition of the gas generating charges 246. The percussion detonator 258 may be of any suitable type such as any of the commercially available models from Core Lab or their subsidiary Owen Oil Tools known as TCP Detonators Support Hardware. The ignition train 212 may also include a booster 260 such as a blasting cap in the event a high order booster is needed to ignite the gas generating charges 246. Shaped charges of the type used in perforating guns may typically require a booster 260 while rocket propellant charges typically do not. The housing 244 may be of any suitable material such as metal, plastic or a composite material and may preferably be simply threaded onto the end of the support 240.

The ignition train 212 may be manipulated in any suitable manner, such as by the application of pressure through a conduit connected to the box 218. To this end, the housing 202 may provide an opening 262 upstream or above the pressure disc 206 and a passageway 264 leading to the end of the through opening 242. A pressure disk 266 such as is available from Fike Corporation of Blue Springs, Mo. may be placed in the opening 262 or passage 264 to isolate the piston assembly 248 from normal pressure surges inside the pipe string in which the tool 200 is run.

Operation of the tool 200 will now be explained. The tool 200 may be run on a pipe string into a well such as in FIG. 3 or 6 to isolate sections of the pipe above and below the tool 200. When the time comes to rupture the discs 206, 208, pressure may be applied from above to rupture the disc 266 and thereby apply pressure to the end of the piston assembly 248. When the applied pressure exceeds the strength of the shear pin 254, the pin 254 fails and the piston assembly 248 moves to the left in FIG. 13 so the firing pin 252 impacts the end of the pressure detonator 258. The pressure detonator 258, most types of which appear to be small diameter pistol cartridges, detonates thereby detonating the booster 260 and igniting the gas generating charges 246. Pressure from the gas generating charges 238 ruptures the discs 206, 208 thereby allowing communication between the ends of the tool 200 and thereby establishing communication through the pipe string in which the tool 200 is situated.

Many of the embodiments disclosed in Ser. No. 12/800,622 rupture one of the discs or domes and rely on well bore pressure to rupture the remaining disc. There may be situations where there is insufficient well bore pressure differential across an unruptured disc to cause it to fail. One of the advantages of using a gas generator to rupture the pressure discs is that both can be ruptured at the same time and not require a well bore pressure differential.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A down hole well isolation tool comprising a housing having a longitudinal passage therethrough, a first end and a second end;

a first disc having a first side capable of withstanding a first pressure differential and a second side capable of withstanding a second pressure differential substantially greater than the first pressure, the second side of the first disc facing the first housing end;

a second disc having a first side capable of withstanding a third pressure differential and a second side capable of withstanding a fourth pressure differential substantially greater than the third pressure differential, the second side of the second disc facing the second housing end;

the first and second discs temporarily blocking flow through the longitudinal passage and comprising at least part of an enclosure resisting pressure applied from the first end of the housing and from the second end of the housing;

the housing providing a passageway from adjacent the first end of the housing into the enclosure; and a gas generating assembly between the discs, fixed at a location between the discs prior to activation of the gas generating assembly, and an ignition train adapted to initiate the assembly upon a pressure command from adjacent the first end of the housing into the enclosure.

2. The down hole well isolation tool of claim 1 wherein the gas generating assembly comprises a propellant.

3. The down hole well isolation tool of claim 1 wherein the gas generating assembly comprises a shaped charge.

4. The downhole well isolation tool of claim 1 wherein the ignition train comprises a pressure operated piston having a retracted position and an extended position and a detonator in the path of the piston and adapted to be ignited by movement of the piston from the retracted position toward the extended position, the gas generating assembly being initiated by the detonator.

5. The down hole isolation tool of claim 1 wherein the gas generator is fixed to the housing.

6. A downhole well isolation tool having a longitudinal passage therethrough and comprising a housing having therein a pair of pressure resistant discs temporarily blocking flow through the longitudinal passage, each disc having a strong side more resistant to pressure applied in a first axial direction and a weak side less resistant to pressure applied in a second opposite axial direction, an upper of the discs' strong side facing an upper end of the housing and a lower of the discs' strong side facing a lower end of the housing and a gas generating assembly fixed at a location, before initiation of the gas generating assembly, between the discs and an ignition train adapted to initiate the gas generating assembly.

7. The down hole well isolation tool of claim 6 wherein the gas generating assembly comprises a propellant.

8. The down hole well isolation tool of claim 6 wherein the gas generating assembly comprises a shaped charge.

9. The down hole isolation tool of claim 6 wherein the gas generator is fixed to the housing.

10. A method of opening a down hole well isolation tool of the type temporarily blocking flow through a longitudinal passage provided by the tool, a housing having a closed wall, an upper end and a lower end; a first disc having a concave side and a convex side, the convex side facing the upper housing end, the first and second discs temporarily blocking flow through the longitudinal passage; a second disc having a concave side and a convex side, the convex side facing the lower housing end; and a gas generating assembly fixed at a location between the discs having an ignition train adapted to initiate the assembly, the method comprising actuating the ignition train and thereby igniting the gas generating assembly thereby producing a pressure rupturing the pressure discs.

11. The method of claim 10 wherein the first and second pressure discs are ruptured substantially simultaneously.

12. A method of opening a down hole well isolation tool of the type temporarily blocking flow through a longitudinal passage provided by the tool, a housing having a passage therethrough, a first end and a second end; a first disc having a first side capable of withstanding a first pressure differential and a second side capable of withstanding a second pressure differential substantially greater than the first pressure, the second side of the first disc facing the first housing end; a second disc having a first side capable of withstanding a third pressure differential and a second side capable of withstanding a fourth pressure differential substantially greater than the third pressure differential the first and second discs temporarily blocking flow through the longitudinal passage, the second side of the second disc facing the second housing end; the method comprising positioning a gas generator in a fixed location between the discs;

initiating operation of the gas generator and applying a pressure between the discs sufficient to rupture both discs simultaneously and thereby opening the passage for flow therethrough.

13. The method of claim 12 wherein the step of positioning the gas generator in a fixed location comprises fixing the gas generator to the housing.

14. A down hole well isolation tool comprising a housing having a longitudinal passage therethrough, a first end and a second end;

a first disc having a first side capable of withstanding a first pressure differential and a second side capable of withstanding a second pressure differential substantially greater than the first pressure, the second side of the first disc facing the first housing end;

a second disc having a first side capable of withstanding a third pressure differential and a second side capable of withstanding a fourth pressure differential substantially greater than the third pressure differential, the second side of the second disc facing the second housing end; the first and second discs temporarily blocking flow through the longitudinal passage; and a gas generator at a fixed location between the discs, prior to actuation of the gas generator, sufficient to produce a pressure to rupture at least one of the discs.

15. The down hole isolation tool of claim 14 wherein the gas generator is fixed to the housing.

16. The down hole isolation tool of claim 14 wherein the gas generator comprises a propellant.

17. The down hole isolation tool of claim 14 wherein the gas generator comprises a shaped charge.

* * * * *